US007075282B2

(12) United States Patent
Feng

(10) Patent No.: US 7,075,282 B2
(45) Date of Patent: Jul. 11, 2006

(54) LOW-POWER BANDGAP REFERENCE CIRCUITS HAVING RELATIVELY LESS COMPONENTS

(75) Inventor: Wei Wen Feng, Taipei (TW)

(73) Assignee: Analog Integrations Corporation (TW)

( * ) Notice: Subject to any disclaimer, the term of this patent is extended or adjusted under 35 U.S.C. 154(b) by 145 days.

(21) Appl. No.: 10/852,060

(22) Filed: May 24, 2004

(65) Prior Publication Data

US 2004/0239303 A1 Dec. 2, 2004

(30) Foreign Application Priority Data

May 27, 2003 (TW) ..... 92114318 A

(51) Int. Cl.
*G05F 3/16* (2006.01)

(52) U.S. Cl. ..... 323/313

(58) Field of Classification Search ..... 323/313, 323/314, 315, 316
See application file for complete search history.

(56) References Cited

U.S. PATENT DOCUMENTS 6,232,829 B1 * 5/2001 Dow ..... 327/539
6,366,071 B1 4/2002 Yu
6,407,622 B1 * 6/2002 Opris ..... 327/539
6,501,256 B1 * 12/2002 Jaussi et al. ..... 323/315
6,642,778 B1 * 11/2003 Opris ..... 327/539
6,885,179 B1 * 4/2005 Ker et al. ..... 323/316
6,930,538 B1 * 8/2005 Chatal ..... 327/539

OTHER PUBLICATIONS

Made Gunawan; Gerard C. M. Meijer; Jeroen Fonderie and Johan H. Huijsing; "A Curvature-Corrected Low-Voltage Bandgap Reference"; IEEE Journal Of Solid-State Circuits, vol. 28, No. 6, Jun. 1993 (pp. 667-670).

* cited by examiner

*Primary Examiner*—Adolf Berhane
(74) *Attorney, Agent, or Firm*—The Webb Law Firm

(57) ABSTRACT

The first proposed circuit includes: a voltage supply; a first current source, including: a first transistor having a first terminal coupled to the voltage supply, a second terminal providing the PTAT current and coupled to an output terminal of the circuit for providing a bandgap reference voltage, and a control terminal; a second current source, including: a first resistor having a first terminal coupled to the voltage supply; and a second transistor having a first terminal coupled to a second terminal of the first resistor, a second terminal providing the PTVBE current and coupled to the output terminal, and a control terminal; and a second resistor having a first terminal coupled to the output terminal, and a second terminal coupled to a common ground. Two current mirror circuits are employed in this circuit.

14 Claims, 5 Drawing Sheets

LOW-POWER BANDGAP REFERENCE CIRCUITS HAVING RELATIVELY LESS COMPONENTS

FIELD OF THE INVENTION

The present invention relates to a bandgap circuit for supplying a reference voltage. More specifically, this invention relates to a bandgap circuit employing the current mirror circuits.

BACKGROUND OF THE INVENTION

Please refer to FIG. 1, it shows the schematic circuit diagram of a first kind of low-power bandgap reference voltage circuits of the prior art. In which, the bandgap circuit includes three same kind of P-type MOSFETs 111, 112, 113, an operational-amplifier (op-amp) 12, two PNP type Bipolar Junction Transistors (BJTs) 131 and 132, and four resistors 14, 15, 161, and 162. Furthermore, the resistances of the resistors 161 and 162 are the same, and the cross measure of the p-n junction of the PNP transistor 132 is an integer factor multiplied by the cross measure of the p-n junction of the PNP transistor 131, and the integer factor is at least 2 such that the PNP transistor 132 can be formed by two PNP transistors each having the same cross measure of the p-n junction of the PNP transistor 131 with the same terminals of the two PNP transistors (the two emitters, the two bases, and the two collectors) coupled to each other respectively.

The two connecting nodes 101 and 102 formed at the two input terminal of the op-amp 12 are said to be virtually short-circuited such that the voltage values at the connecting nodes 101 and 102 are the same respectively. Thus, the difference between the base-emitter voltage of the PNP transistor 131 ($V_{BE131}$) and the base-emitter voltage of the PNP transistor 132 ($V_{BE132}$), $\Delta V_{BE132}$, equals to the voltage across the two terminals of the resistor 14 (as shown in FIG. 1), and which can be expressed as follows:

$$\Delta V_{BE132}=V_{BE131}-V_{BE132} \tag{1}$$

Thus, the current flowed through the resistor 14 (having a resistance of $R_{14}$) can be expressed as follows:

$$i_{R14}=\Delta V_{BE132}/R_{14} \tag{2}$$

Since the voltage value at the connecting node 101 ($V_{BE131}$) equals to the voltage value at the connecting node 102, the current flowed through resistor 162 (having a resistance of $R_{162}$) can be expressed as follows:

$$i_{R162}=V_{BE131}/R_{162} \tag{3}$$

Since the current flowed through the drain of the P-type MOSFET 112 equals to the sum of the currents flowed through the resistors 14 and 162 respectively, and the three same kind of P-type MOSFETs 111, 112, 113 constitute a current mirror circuit, the current flowed through the resistor 15 (having a resistance $R_{15}$) is the sum of the currents flowed through the resistors 14 and 162 respectively, and can be expressed as follows:

$$i_{R15}=i_{R14}+i_{R162}=\Delta V_{BE132}/R_{14}+V_{BE131}/R_{162} \tag{4}$$

Thus, the bandgap reference voltage outputted from the connecting node 103 can be expressed as follows:

$$V_{ref}=i_{R15}R_{15}=R_{15}(\Delta V_{BE132}/R_{14}+V_{BE131}/R_{162})=R_{15}(IPTAT+IPTVBE) \tag{5}$$

When the circuit of FIG. 1 is compared to the traditional bandgap circuits, the item $V_{BE131}$, which relates to the IPTVBE of the $V_{ref}$ equation (5), is multiplied by a factor, $1/R_{162}$, such that the output of the bandgap reference voltage $V_{ref}$ is relatively lower than the traditional bandgap reference voltages due to that two extra resistors 161 and 162 both having the same resistance are included. Through the properly choosing of the resistances of resistors 14, 15 and 162, the bandgap reference voltage outputted from the connecting node 103, $V_{ref}$, would not be varied according to the absolute temperature since the $\Delta V_{BE132}$ and $V_{BE131}$ are proportional to and inversely proportional to the absolute temperature respectively.

Two extra resistors, 161 and 162, both having the same resistance and the relatively high current value flowed through, are coupled to the terminals 102 and 103 respectively in the above-mentioned bandgap circuit for the purpose of achieving a relatively lower bandgap reference voltage. When the layouts of the ICs are under considerations, a relatively larger cross measure is needed for such a circuit, and which would become an unpractical drawback of this kind of bandgap circuits.

Please refer to FIG. 2, it shows the schematic circuit diagram of a second kind of low-power bandgap reference voltage circuits of the prior art. This bandgap circuit includes a current source 21, which offers a current proportional to the absolute temperature (IPTAT), a current source 22, which offers a current proportional to the base-emitter voltage (IPTVBE), PNP transistor 23, and the resistors 24 and 25 respectively.

Since the potential difference between the connecting node 201 and the connecting node 202 equals to the base-emitter voltage of the transistor 23 ($V_{BE23}$), the current flowed through the resistor 24 (having a resistance of R24) can be expressed as follows:

$$IPTVBE=V_{BE23}/R_{24} \tag{6}$$

The bandgap reference voltage outputted from the connecting node 203 can be expressed as follows:

$$V_{ref}=R_{15}(IPTAT+IPTVBE)=R_{15}(IPTAT+V_{BE23}/R_{24}) \tag{7}$$

Just like the aforementioned first kind of bandgap circuits, each of the second kind of bandgap circuits having an extra resistor 24 such that the item $V_{BE23}$, which relates to the IPTVBE of the $V_{ref}$ equation (7), is multiplied by a factor $1/R_{24}$ such that the output of the bandgap reference voltage, $V_{ref}$, is relatively lower than that of the traditional bandgap circuits. When compared with the first kind of bandgap circuits, only one resistor 24 having the relatively high current value flowed through for producing the IPTVBE is employed in each of the second kind of the bandgap circuits, but one more PNP type BJT 23 is employed though. Besides, the IPTAT and the IPTVBE are generated sequentially in each of this kind of circuits such that a relatively more complex configuration of the circuit is needed when it is compared with one of the first kind of bandgap circuits. But in the latter one, the IPTAT and the IPTVBE are generated simultaneously since a current mirror circuit is employed.

Please refer to FIG. 3, it shows the schematic circuit diagram of a third kind of low-power bandgap reference voltage circuits of the prior art. Each of this third kind of bandgap circuits includes a current source 31, which offers the IPTAT, a current source 32, which offers the IPTVBE, a resistor 33 coupled to a common ground, and a connecting node 30 providing a low-power reference voltage proportional to the sum of the IPTAT and the IPTVBE and coupled to the current sources 31 and 32 and the resistor 33. In which, the low-power reference voltage can be expressed as follows:

$$V_{ref}=R_{33}(IPTAT+IPTVBE) \tag{8}$$

The basic theoretical configuration of this kind of bandgap circuits was first proposed by M. Gunawan, et. al, in the paper: "A Curvature-Corrected Low-Voltage Bandgap Reference", IEEE J. of Solid-State Circuits, Vol. SC-28, No. 6, pp. 667–670, June 1993. The U.S. Pat. No. 6,366,071 B1 (H. C. Yu) was built on the above-mentioned basic configuration (as shown in FIGS. 3 and 4 of the '071 Patent). But, the detailed configuration of the bandgap circuits disclosed in the '071 Patent is relatively complex having ten MOSFETs, three BJTs, and two resistors (as shown in FIG. 5 of the '071 Patent). To build up a new kind of bandgap circuits each having a much simpler configuration and the same level of efficiency according to the aforementioned basic theoretical configuration would be the next challenge.

Keeping the drawbacks of the prior arts in mind, and employing experiments and research full-heartily and persistently, the applicant finally conceived the low-power bandgap circuits having relatively less components.

SUMMARY OF THE INVENTION

It is therefore an object of the present invention to propose two low-power bandgap circuits each having the relatively less components and the same level of efficiency.

According to the aspect of the present invention, the low-power bandgap reference circuit includes: a voltage supply; a first current source for providing a proportional to absolute temperature (PTAT) current, including: a first transistor having a first terminal coupled to the voltage supply, a second terminal providing the PTAT current and coupled to an output terminal of the circuit for providing a bandgap reference voltage, and a control terminal; a second current source for providing a proportional to base-emitter voltage (PTVBE) current, including: a first resistor having a first terminal coupled to the voltage supply; and a second transistor having a first terminal coupled to a second terminal of the first resistor, a second terminal providing the PTVBE current and coupled to the output terminal, and a control terminal; and a second resistor having a first terminal coupled to the output terminal, and a second terminal coupled to a common ground.

Preferably, the first current source further includes: a third to a sixth transistors each having a first, a second and a control terminals, and having the first terminals of the third and the fourth transistors coupled to the voltage supply, the control and the second terminals of the fourth transistor coupled to the control terminals of the first and the third transistors, the second terminal of the fifth transistor coupled to the control terminal of the second transistor and the second terminal of the third transistor, the second terminal of the sixth transistor coupled to the second terminal of the fourth transistor, the control terminal of the sixth transistor coupled to the control terminal of the fifth transistor, and the first terminal of the sixth transistor coupled to the common ground respectively; a third resistor having a first and a second terminals coupled to the first terminal of the fifth transistor and the common ground respectively; and a fourth resistor having a first and a second terminals coupled to the control terminal of the sixth transistor, and the common ground respectively.

Preferably, the second current source further includes: a fifth resistor having a first terminal coupled to the voltage supply; a seventh transistor having a first terminal coupled to a second terminal of the fifth resistor, a second terminal coupled to the first terminal of the fourth resistor, and a control terminal coupled to the control terminal of the second transistor; and a compensating circuit for compensating the PTVBE current, including: a capacitor having a first terminal coupled to the control terminal of the seventh transistor; and the sixth resistor having a first terminal coupled to a second terminal of the capacitor and a second terminal coupled to the control terminal of the sixth transistor.

Preferably, the first, the third and the fourth transistors are p-type MOSFETs, the first, the second, and the control terminals of the first, the third, and the fourth transistors are sources, drains, and gates of the MOSFETs, the second and the fifth to the seventh transistors are Bipolar-Junction Transistors (BJTs), the first, the second, and the control terminals of the second and the fifth to the seventh transistors are emitters, collectors, and bases of the BJTs, the second and the seventh transistors are PNP transistors, and the fifth and the sixth transistors are NPN transistors respectively.

Preferably, a square measure of p-n junction of the fifth transistor equals to an integer factor multiplied by a square measure of p-n junction of the sixth transistor, and the integer factor is at least 2.

According to another aspect of the present invention, the low-power bandgap reference circuit includes: a voltage supply; a first current source for providing a proportional to absolute temperature (PTAT) current, including: a first transistor having a first terminal coupled to the voltage supply, a second terminal providing the PTAT current and coupled to an output terminal of the circuit for providing a bandgap reference voltage, and a control terminal; a second current source for providing a proportional to base-emitter voltage (PTVBE) current, including: a second transistor having a first terminal coupled to the voltage supply, a second terminal providing the PTVBE current and coupled to the output terminal, and a control terminal; and a first resistor having a first terminal coupled to the output terminal, and a second terminal coupled to a common ground.

Preferably, the first current source further includes: a third to a sixth transistors each having a first, a second and a control terminals, and having the first terminals of the third and the fourth transistors coupled to the voltage supply, the control terminal of the fourth transistor coupled to the control terminal of the first transistor, the second and the control terminals of the third transistor, and the second terminal of the fifth transistor, the second terminal of the sixth transistor coupled to the second terminal of the fourth transistor, the control terminal of the sixth transistor coupled to the control terminal of the fifth transistor, and the first terminal of the sixth transistor coupled to the common ground respectively; a second resistor having a first and a second terminals coupled to the first terminal of the fifth transistor and the common ground respectively; and a third resistor having a first and a second terminals coupled to the control terminal of the sixth transistor, and the common ground respectively.

Preferably, the second current source further includes: a seventh transistor having a first terminal coupled to the voltage supply, a second terminal coupled to the control terminal of the second transistor, and a control terminal coupled to the second terminal; and an eighth transistor having a first terminal coupled to the first terminal of the third resistor, a second terminal coupled to the second terminal of the seventh transistor, and a control terminal coupled to the second terminal of the sixth transistor.

Preferably, the first to the fourth and the seventh transistors are p-type MOSFETs, the eighth transistor is an n-type MOSFET, the first, the second, and the control terminals of the first to the fourth and the seventh to the eighth transistors are sources, drains, and gates of the MOSFETs, the fifth and the sixth transistors are Bipolar-Junction Transistors (BJTs), the first, the second, and the control terminals of the fifth and the sixth transistors are emitters, collectors, and bases of the BJTs, and the fifth and the sixth transistors are NPN transistors respectively.

Preferably, a square measure of p-n junction of the fifth transistor equals to an integer factor multiplied by a square measure of p-n junction of the sixth transistor, and the integer factor is at least 2.

According to another aspect of the present invention, the low-power bandgap reference circuit includes: a voltage supply; a first current source for providing a proportional to absolute temperature (PTAT) current, including: a first transistor having a first terminal coupled to the voltage supply, a second terminal providing the PTAT current and coupled to an output terminal of the circuit for providing a bandgap reference voltage, and a control terminal; a second to a fifth transistors each having a first, a second and a control terminals, and having the first terminals of the second and the third transistors coupled to the voltage supply, the second and the control terminals of the third transistor coupled to the control terminals of the first and the second transistors, the second terminal of the fourth transistor coupled to the second terminal of the second transistor, the second terminal of the fifth transistor coupled to the second terminal of the third transistor, the control terminal of the fifth transistor coupled to the control terminal of the fourth transistor, and the first terminal of the fifth transistor coupled to a common ground respectively; a first resistor having a first and a second terminals coupled to the first terminal of the fourth transistor and the common ground respectively; and a second resistor having a first and a second terminals coupled to the control terminal of the fifth transistor and the common ground respectively; a second current source for providing a proportional to base-emitter voltage (PTVBE) current, including: a third resistor having a first terminal coupled to the voltage supply; and a sixth transistor having a first terminal coupled to a second terminal of the third resistor, a second terminal providing the PTVBE current and coupled to the output terminal, and a control terminal coupled to the second terminal of the fourth transistor; a fourth resistor having a first terminal coupled to the voltage supply; a seventh transistor having a first terminal coupled to a second terminal of the fourth resistor, a second terminal coupled to the first terminal of the second resistor, and a control terminal coupled to the control terminal of the sixth transistor; and a compensating circuit for compensating the PTVBE current, including: a capacitor having a first terminal coupled to the control terminal of the seventh transistor; and a fifth resistor having a first terminal coupled to a second terminal of the capacitor and a second terminal coupled to the control terminal of the fifth transistor; and a sixth resistor having a first terminal coupled to the output terminal of the circuit, and a second terminal coupled to the common ground.

Preferably, the first to the third transistors are p-type MOSFETs, the first, the second, and the control terminals of the first to the third transistors are sources, drains, and gates of the MOSFETs, the fourth to the seventh transistors are Bipolar-Junction Transistors (BJTs), the first, the second, and the control terminals of the fourth to the seventh transistors are emitters, collectors, and bases of the BJTs, the fourth and the fifth transistors are NPN transistors, and the sixth and the seventh transistors are PNP transistors respectively.

Preferably, a square measure of p-n junction of the fourth transistor equals to an integer factor multiplied by a square measure of p-n junction of the fifth transistor, and the integer factor is at least 2.

According to another aspect of the present invention, the low-power bandgap reference circuit includes: a voltage supply; a first current source for providing a proportional to absolute temperature (PTAT) current, including: a first transistor having a first terminal coupled to the voltage supply, a second terminal providing the PTAT current and coupled to an output terminal of the circuit for providing a bandgap reference voltage, and a control terminal; a second to a fifth transistors each having a first, a second and a control terminals, and having the first terminals of the second and the third transistors coupled to the voltage supply, the control terminal of the third transistor coupled to the control terminal of the first transistor, the second and the control terminals of the second transistor, and the second terminal of the fourth transistor, the second terminal of the fifth transistor coupled to the second terminal of the third transistor, the control terminal of the fifth transistor coupled to the control terminal of the fourth transistor, and the first terminal of the fifth transistor coupled to a common ground respectively; a first resistor having a first and a second terminals coupled to the first terminal of the fourth transistor and the common ground respectively; and a second resistor having a first and a second terminals coupled to the control terminal of the fifth transistor, and the common ground respectively; a second current source for providing a proportional to base-emitter voltage (PTVBE) current, including: a sixth transistor having a first terminal coupled to the voltage supply, a second terminal providing the PTVBE current and coupled to the output terminal, and a control terminal; a seventh transistor having a first terminal coupled to the voltage supply, a second terminal coupled to the control terminal of the sixth transistor, and a control terminal coupled to the second terminal; and an eighth transistor having a first terminal coupled to the first terminal of the second resistor, a second terminal coupled to the second terminal of the seventh transistor, and a control terminal coupled to the second terminal of the fifth transistor; and a third resistor having a first terminal coupled to the output terminal, and a second terminal coupled to the common ground.

Preferably, the first to the third, the sixth and the seventh transistors are p-type MOSFETs, the eighth transistor is an n-type MOSFET, the first, the second, and the control terminals of the first to the third and the sixth to the eighth transistors are sources, drains, and gates of the MOSFETs, the fourth and the fifth transistors are Bipolar-Junction Transistors (BJTs), the first, the second, and the control terminals of the fourth and the fifth transistors are emitters, collectors, and bases of the BJTs, and the fourth and the fifth transistors are NPN transistors respectively.

Preferably, a square measure of p-n junction of the fourth transistor equals to an integer factor multiplied by a square measure of p-n junction of the fifth transistor, and the integer factor is at least 2.

The present invention may best be understood through the following descriptions with reference to the accompanying drawings, in which:

DETAILED DESCRIPTION OF THE PREFERRED EMBODIMENT

Figure 3:
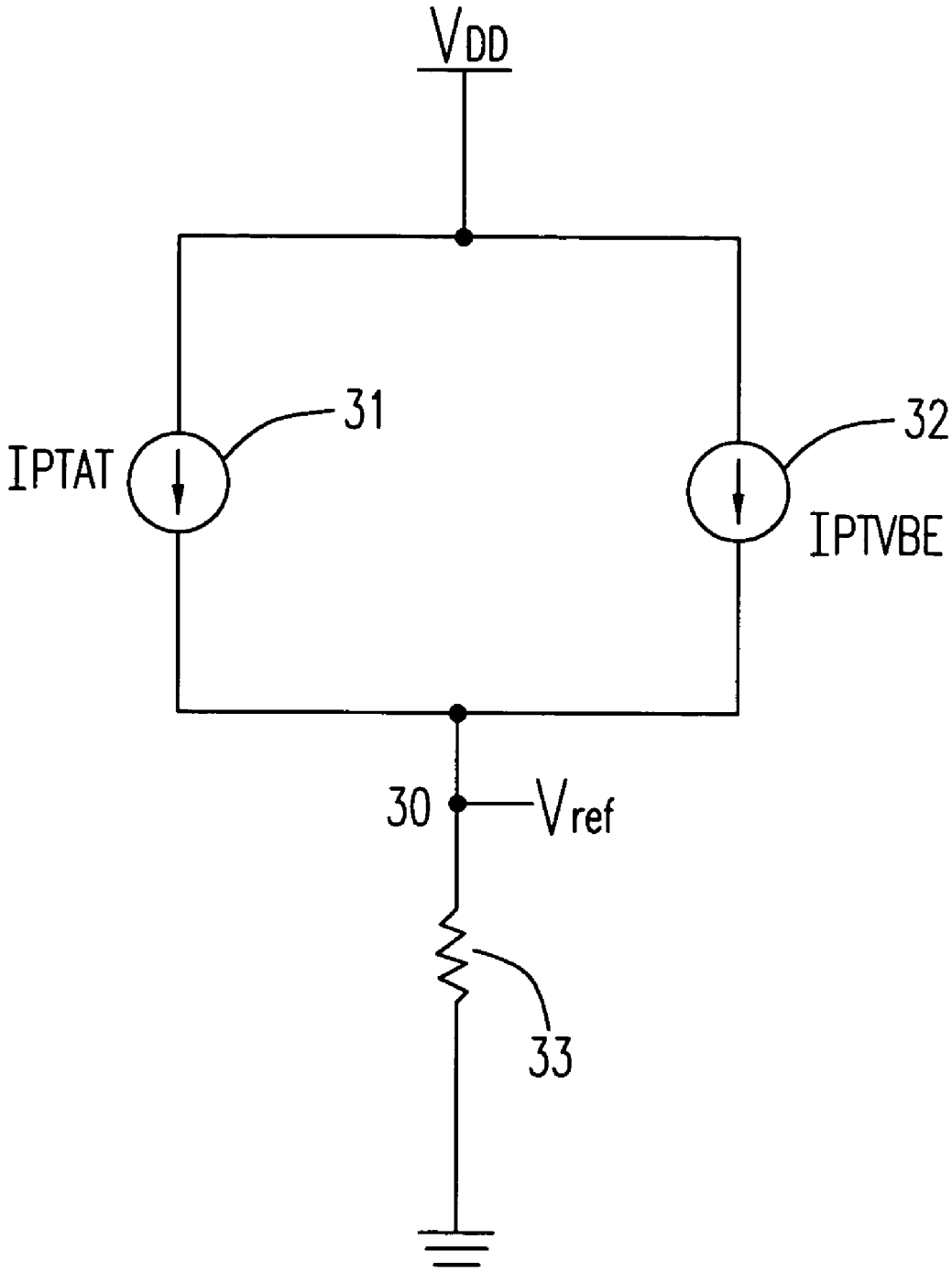
Fig. 3(PRIOR ART)
FIG. 3 is the schematic circuit diagram of the third kind of the low-power bandgap reference circuits of the prior art.
Figure 4:
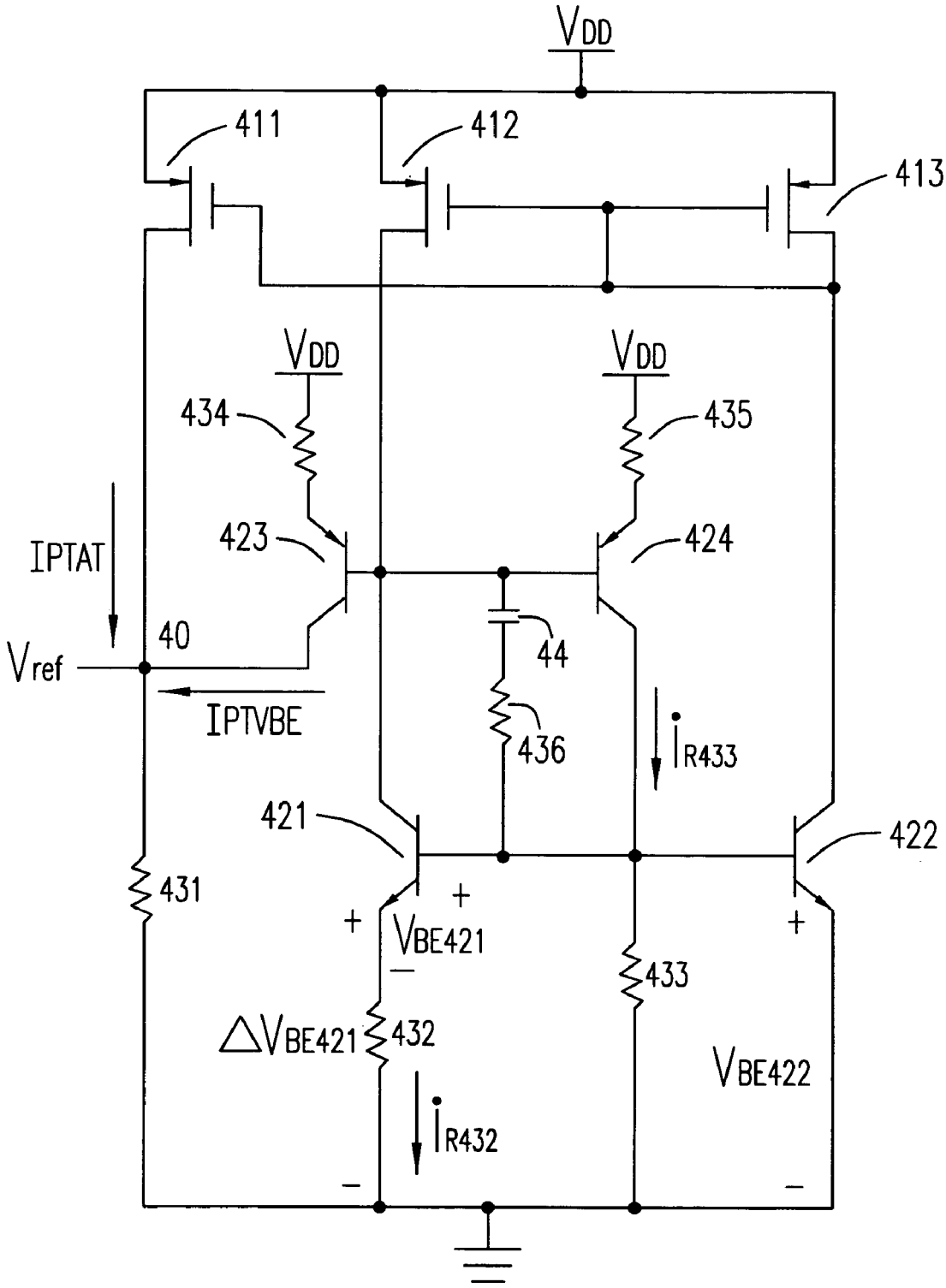
FIG. 4 shows the schematic circuit diagram of the first preferred embodiment of the proposed low-power bandgap reference circuits of the present invention.

Please refer to FIG. 4, it shows the schematic circuit diagram of the first preferred embodiment of the proposed low-power bandgap reference circuits of the present invention, which is built up according to the basic configuration of the third kind of lower power bandgap reference circuits (as shown in FIG. 3) each having the relatively less components and the same level of efficiency through employing two different sets of the current mirror circuits. In which, the proportional to absolute temperature (PTAT) current source includes: three same kind of P-type MOSFETs 411–413 (which constitute a first current mirror circuit), two NPN type BJTs 421 and 422, and three resistors 431–433, a square measure of p-n junction of the NPN transistor 421 equals to an integer factor multiplied by a square measure of p-n junction of the NPN transistor 422, and the integer factor is at least 2. Furthermore, the proportional to base-emitter voltage (PTVBE) current source includes: two same kind of PNP type BJTs 423–424 (which constitute a second current mirror circuit), and resistors 434–435.

In FIG. 4, the proposed low-power bandgap reference circuit includes: a voltage supply $V_{DD}$; a first current source for providing a proportional to absolute temperature (PTAT) current, including: a first transistor 411 having a first terminal coupled to the voltage supply $V_{DD}$, a second terminal providing the PTAT current and coupled to an output terminal 40 of the circuit for providing a bandgap reference voltage $V_{ref}$, and a control terminal; a second to a fifth transistors 412–413 and 421–422 each having a first, a second and a control terminals, and having the first terminals of the second and the third transistors 412–413 coupled to the voltage supply $V_{DD}$, the second and the control terminals of the third transistor 413 coupled to the control terminals of the first and the second transistors 411–412, the second terminal of the fourth transistor 421 coupled to the second terminal of the second transistor 412, the second terminal of the fifth transistor 422 coupled to the second terminal of the third transistor 413, the control terminal of the fifth transistor 422 coupled to the control terminal of the fourth transistor 421, and the first terminal of the fifth transistor 422 coupled to a common ground respectively; a first resistor 432 having a first and a second terminals coupled to the first terminal of the fourth transistor 421 and the common ground respectively; and a second resistor 433 having a first and a second terminals coupled to the control terminal of the fifth transistor 422 and the common ground respectively; a second current source for providing a proportional to base-emitter voltage (PTVBE) current, including: a third resistor 434 having a first terminal coupled to the voltage supply $V_{DD}$; and a sixth transistor 423 having a first terminal coupled to a second terminal of the third resistor 434, a second terminal providing the PTVBE current and coupled to the output terminal 40, and a control terminal coupled to the second terminal of the fourth transistor 421; a fourth resistor 435 having a first terminal coupled to the voltage supply $V_{DD}$; a seventh transistor 424 having a first terminal coupled to a second terminal of the fourth resistor 435, a second terminal coupled to the first terminal of the second resistor 433, and a control terminal coupled to the control terminal of the sixth transistor 423; and a compensating circuit for compensating the PTVBE current so as to maintain the stability of the operational voltage, including: a capacitor 44 having a first terminal coupled to the control terminal of the seventh transistor 424; and a fifth resistor 436 having a first terminal coupled to a second terminal of the capacitor 44 and a second terminal coupled to the control terminal of the fifth transistor 421; and a sixth resistor 431 having a first terminal coupled to the output terminal of the circuit 40 , and a second terminal coupled to the common ground.

In FIG. 4, the difference between the base-emitter voltage of the PNP transistor 421 ($V_{BE421}$) and the base-emitter voltage of the PNP transistor 422 ($V_{BE422}$) is $\Delta V_{BE421}$, and the current flowed through resistor 432 (with a resistance of $R_{432}$) can be expressed as follows:

$$i_{R432}=\Delta V_{BE421}/R_{432} \tag{9}$$

Since the three same kind of P-type MOSFETs 411–413 constitute a first current mirror circuit, the currents flow through the drains of the P-type MOSFETs 411 and 412 equal to each other respectively, and the IPTAT can be expressed as follows:

$$IPTAT=i_{R432}=\Delta V_{BE421}/R_{432} \tag{10}$$

Furthermore, the current flows through the resistor 433 can be expressed as follows:

$$i_{R433}=V_{BE422}/R_{433} \tag{11}$$

Since the PNP transistors 423 and 424 constitute a second current mirror circuit, the currents flow through the collectors of the PNP transistors 423 and 424 equal to each other respectively, and the IPTVBE can be expressed as follows:

$$IPTVBE=i_{R433}=V_{BE422}/R_{433} \tag{12}$$

Therefore, the reference voltage outputted from the connecting node 40, $V_{ref}$, can be expressed as follows:

$$V_{ref}=R_{431}(IPTAT+IPTVBE)=R_{431}(\Delta V_{BE421}/R_{432}+V_{BE422}/+R_{433}) \tag{13}$$

In the formula (13), $\Delta V_{BE421}$ and $V_{BE422}$ are proportional to and inversely proportional to the absolute temperature respectively. Thus, the relatively low bandgap reference voltage outputted from the connecting node 40 of the proposed bandgap reference circuit (as shown in FIG. 4) would not be varied according to the absolute temperature through the properly choosing of the resistances of resistors 431–433.

Figure 1:
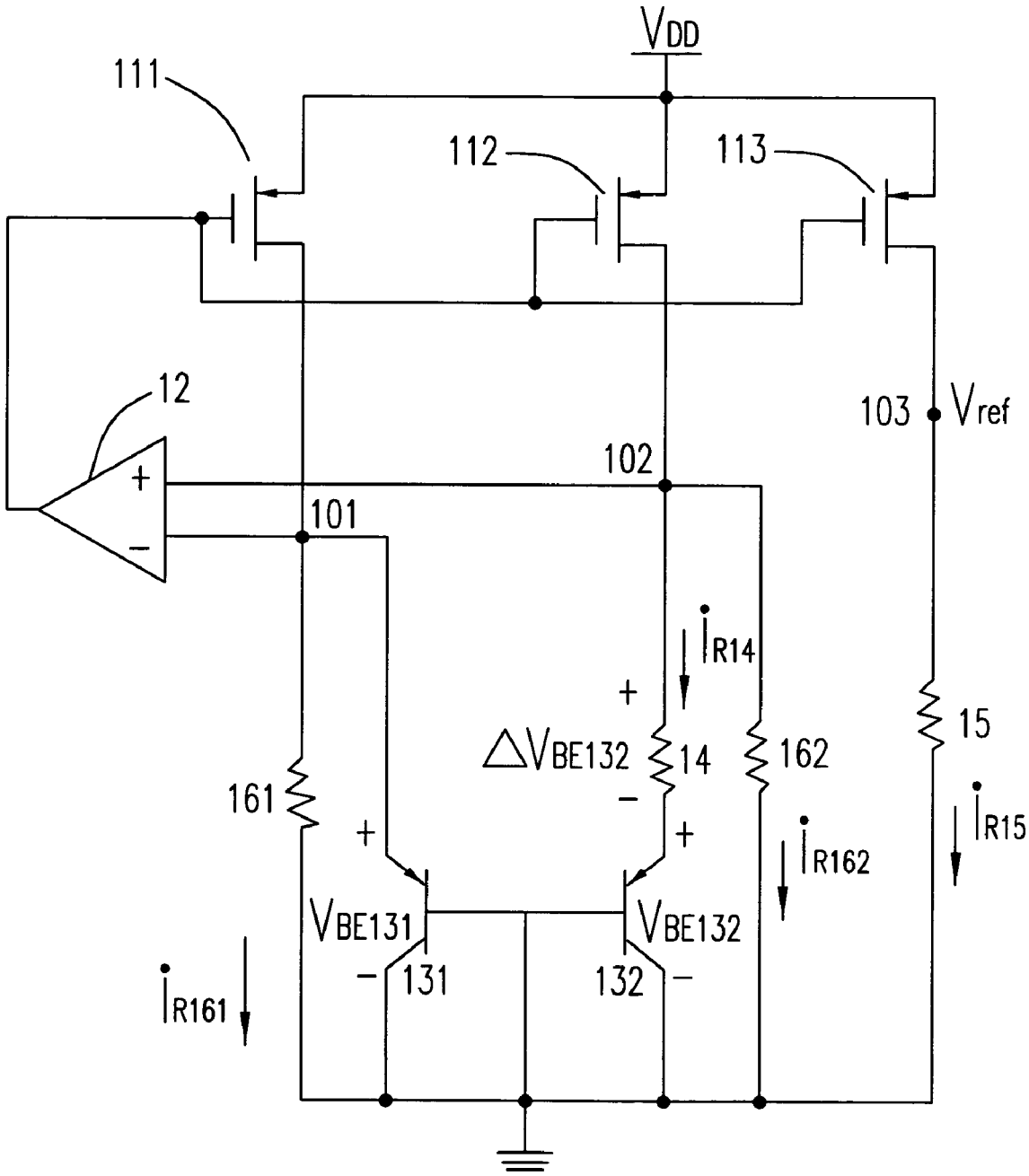
Fig. 1 (PRIOR ART)
FIG. 1 is the schematic circuit diagram of the first kind of the low-power bandgap reference circuits of the prior art.
Figure 2:
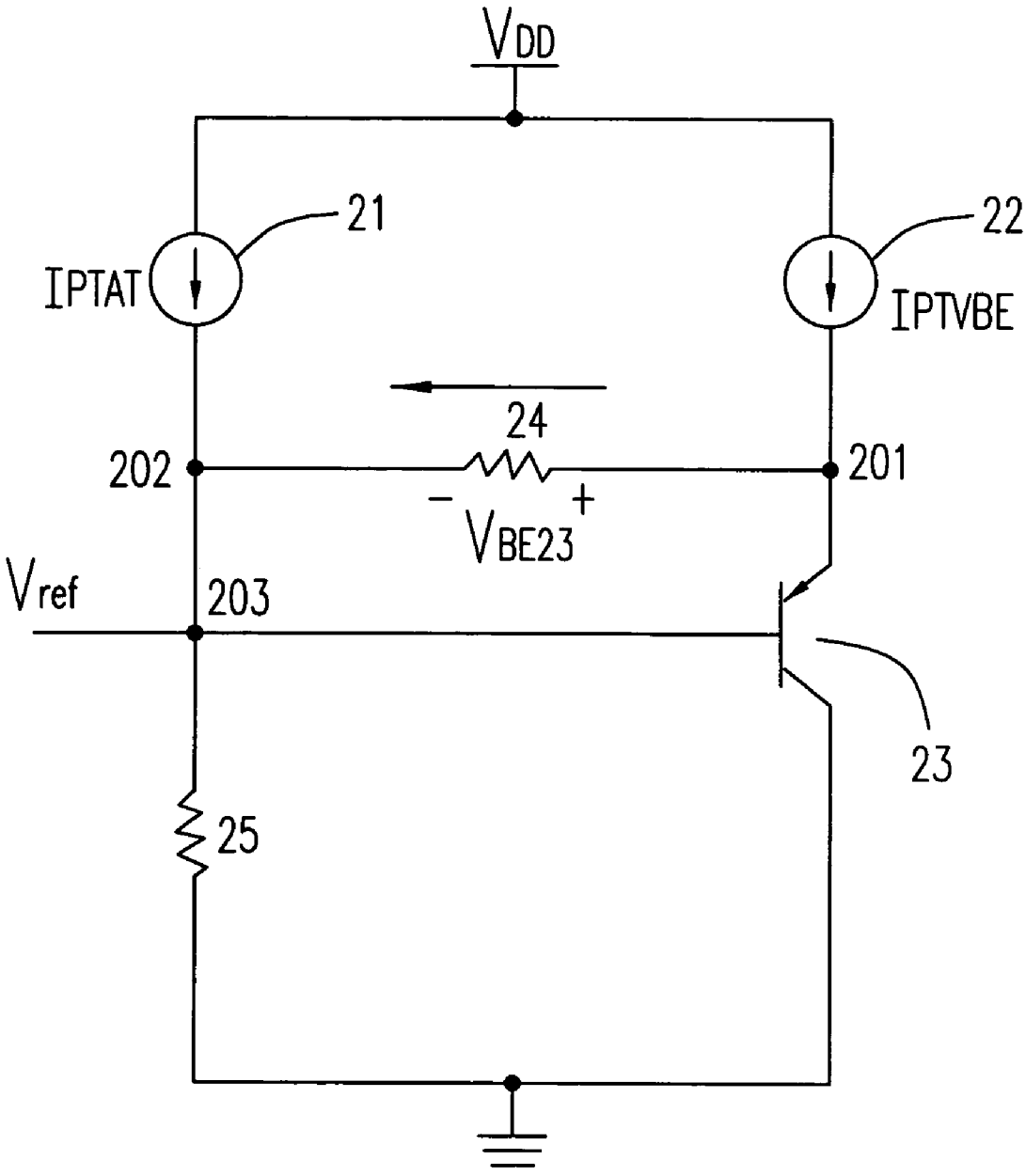
Fig. 2(PRIOR ART)
FIG. 2 is the schematic circuit diagram of the second kind of the low-power bandgap reference circuits of the prior art.

In the aforementioned first proposed circuit of the present invention (as shown in FIG. 4), the real operational voltage can be realized around 1.4 volts due to the compensating effects towards IPTVBE caused by the capacitor 44 and resistor 436 and the degenerations of the PNP transistors 423 and 424. Besides, the proposed circuit of the first preferred embodiment of the present invention has one less resistor with relatively high current value for generating the IPTVBE than the schematic circuit diagram of the first kind of bandgap reference circuits (as shown in FIG. 1) so as to have a relatively smaller cross measure of the proposed bandgap circuit to facilitate the layouts of the ICs. Two different sets of the current mirror circuits are employed so as to generate the relatively lower IPTAT and IPTVBE simultaneously in the first preferred embodiment of the proposed bandgap circuits of the present invention, but the IPTAT is generated by a different circuit firstly and is reflected to the place where the IPTVBE is located by the mirror circuit later on in the second kind of the low-power bandgap reference circuits of the prior art. Thus, the configuration of the first preferred embodiment of the proposed low-power bandgap reference circuits of the present invention is much simpler than that of the schematic circuit diagram of the second kind of bandgap reference circuits. Due to the same reasons that two different sets of mirror circuits are employed in the first preferred embodiment of the proposed low-power bandgap reference circuits to generate the relatively lower IPTAT and IPTVBE simultaneously so as to output a relatively low reference voltage, the configuration of the circuit of the first preferred embodiment of the present invention is also simpler than that of the '071 Patent.

Figure 5:
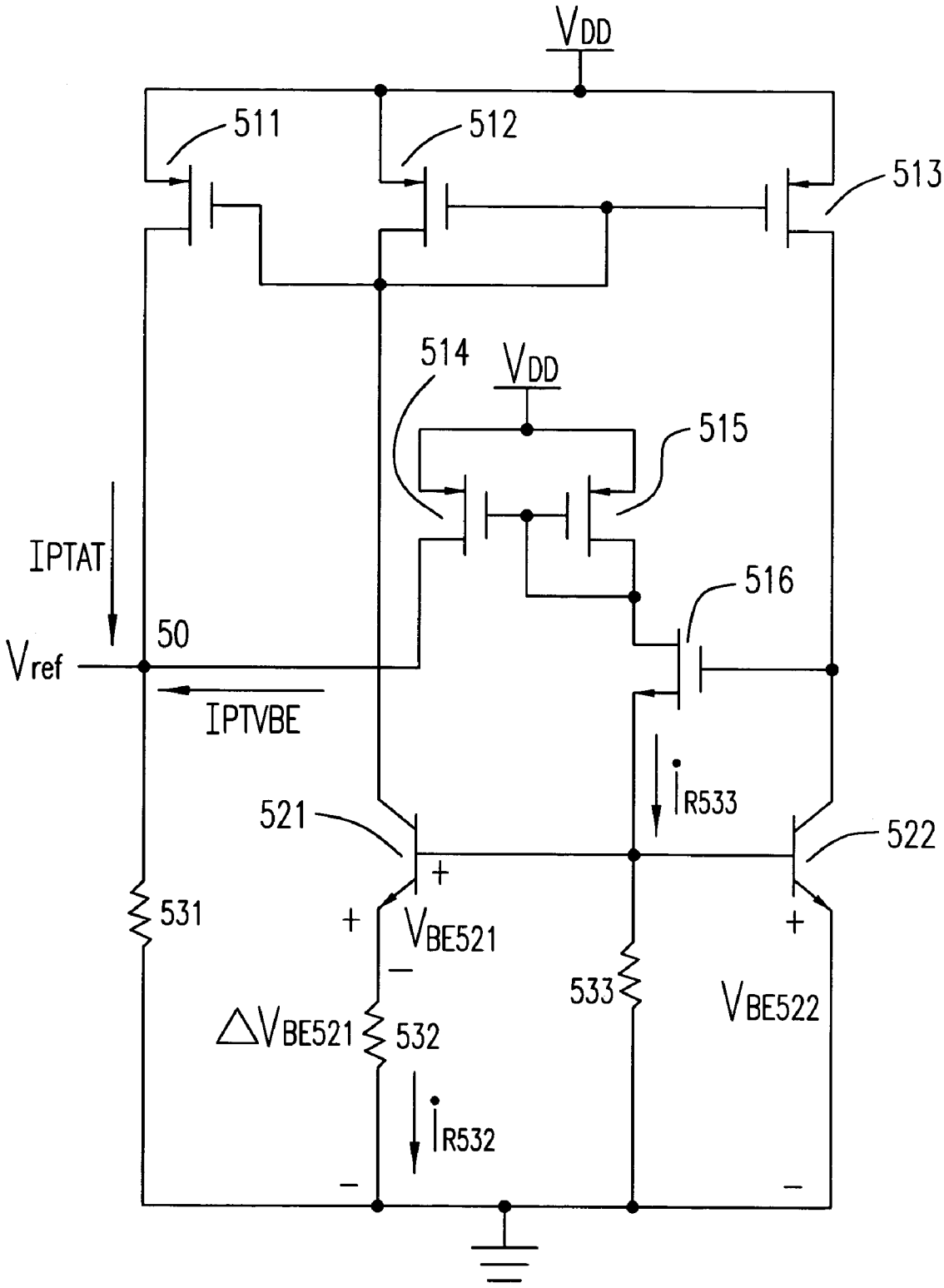
FIG. 5 shows the schematic circuit diagram of the second preferred embodiment of the proposed low-power bandgap reference circuits of the present invention.

Please refer to FIG. 5, it shows the schematic circuit diagram of the second preferred embodiment of the proposed low-power bandgap reference circuits of the present invention, which is also built up according to the basic configuration of the third kind of lower power bandgap reference circuits (as shown in FIG. 3) having the relatively less components and the same level of efficiency through employing two different sets of the current mirror circuits. In which, the proportional to absolute temperature (PTAT) current source includes: three same kind of P-type MOSFETs 511–513 (which constitute a first current mirror circuit), two NPN type BJTs 521 and 522, and three resistors 531–533, a square measure of p-n junction of the NPN transistor 521 equals to an integer factor multiplied by a square measure of p-n junction of the NPN transistor 522, and the integer factor is at least 2. Furthermore, the proportional to base-emitter voltage (PTVBE) current source includes: two same kind of P-type MOSFETs 514–515 (which constitute a second current mirror circuit), and an N-type MOSFET 516.

In FIG. 5, the proposed low-power bandgap reference circuit includes: a voltage supply $V_{DD}$; a first current source for providing a proportional to absolute temperature (PTAT) current, including: a first transistor 511 having a first terminal coupled to the voltage supply $V_{DD}$, a second terminal providing the PTAT current and coupled to an output terminal 50 of the circuit for providing a bandgap reference voltage $V_{ref}$, and a control terminal; a second to a fifth transistors 512–513 and 521–522 each having a first, a second and a control terminals, and having the first terminals of the second and the third transistors 512–513 coupled to the voltage supply $V_{DD}$, the control terminal of the third transistor 513 coupled to the control terminal of the first transistor 511, the second and the control terminals of the second transistor 512, and the second terminal of the fourth transistor 521, the second terminal of the fifth transistor 522 coupled to the second terminal of the third transistor 513, the control terminal of the fifth transistor 522 coupled to the control terminal of the fourth transistor 521, and the first terminal of the fifth transistor 522 coupled to a common ground respectively; a first resistor 532 having a first and a second terminals coupled to the first terminal of the fourth transistor 521 and the common ground respectively; and a second resistor 533 having a first and a second terminals coupled to the control terminal of the fifth transistor 522 and the common ground respectively; a second current source for providing a proportional to base-emitter voltage (PTVBE) current, including: a sixth transistor 514 having a first terminal coupled to the voltage supply $V_{DD}$, a second terminal providing the PTVBE current and coupled to the output terminal 50, and a control terminal; a seventh transistor 515 having a first terminal coupled to the voltage supply $V_{DD}$, a second terminal coupled to the control terminal of the sixth transistor 514, and a control terminal coupled to the second terminal; and an eighth transistor 516 having a first terminal coupled to the first terminal of the second resistor 533, a second terminal coupled to the second terminal of the seventh transistor 515, and a control terminal coupled to the second terminal of the fifth transistor 522; and a third resistor 531 having a first terminal coupled to the output terminal 50, and a second terminal coupled to the common ground.

In FIG. 5, the difference between the base-emitter voltage of the PNP transistor 521 ($V_{BE521}$) and the base-emitter voltage of the PNP transistor 522 ($V_{BE522}$) is $\Delta V_{BE521}$, and the current flowed through resistor 532 (with a resistance of $R_{532}$) can be expressed as follows:

$$i_{R532}=\Delta V_{BE521}/R_{532} \tag{14}$$

Since the three same kind of P-type MOSFETs 511–513 constitute a first current mirror circuit, the currents flow through the drains of the P-type MOSFETs 511 and 512 equal to each other respectively, and the IPTAT can be expressed as follows:

$$IPTAT=i_{R532}=\Delta V_{BE521}/R_{532} \tag{15}$$

Furthermore, the current flows through the resistor 533 can be expressed as follows:

$$i_{R533}=V_{BE522}/R_{533} \tag{16}$$

Since the PNP transistors 514 and 515 constitute a second current mirror circuit, the currents flow through the drains of the P-type MOSFETs 514 and 515 equal to each other respectively, and the IPTVBE can be expressed as follows:

$$IPTVBE=i_{R533}=V_{BE522}/R_{533} \tag{17}$$

Thus, the reference voltage outputted from the connecting node 50, $V_{ref}$, can be expressed as follows:

$$V_{ref}=R_{531}(IPTAT+IPTVBE)=R_{531}(\Delta V_{BE521}/R_{532}+V_{BE522}/R_{533}) \tag{18}$$

In the formula (18), $\Delta V_{BE521}$ and $V_{BE522}$ are proportional to and inversely proportional to the absolute temperature respectively. Thus, the relatively low bandgap reference voltage outputted from the connecting node 50 of the proposed bandgap reference circuit (as shown in FIG. 5) would not be varied according to the absolute temperature through the properly choosing of the resistances of resistors 531–533.

The main difference between the first and second proposed circuits of the present invention (as shown in FIGS. 4 and 5 respectively) is that there is no compensating circuit in the second proposed circuit of the present invention. Though with a relatively simpler configuration, but the operational voltage of the second proposed circuit of the present invention is realized at a higher level of around 2.0 volts. Furthermore, the proposed circuit of the second preferred embodiment of the present invention has one less resistor with relatively high current value for generating the IPTVBE than the schematic circuit diagram of the first kind of the bandgap reference circuits (as shown in FIG. 1) so as to have a relatively smaller cross measure of the proposed bandgap circuit to facilitate the layouts of the ICs. Two different sets of the current mirror circuits are also employed so as to generate the IPTAT and the IPTVBE simultaneously in the second preferred embodiment of the proposed bandgap circuits, but the IPTAT is generated by some other circuit firstly and is reflected to the place where the IPTVBE is located by the mirror circuit later on in the second kind of the low-power bandgap reference circuits of the prior art. Thus, the configuration of the second preferred embodiment of the proposed low-power bandgap reference circuits is much simpler than that of the schematic circuit diagram of the second kind of bandgap reference circuits. Due to the same reasons that two different mirror circuits are employed in the second preferred embodiment of the proposed low-power bandgap reference circuits to generate a relatively low reference voltage, the configuration of the circuit of the second preferred embodiment of the present invention is also simpler than that of the '071 Patent.

According to the above descriptions, the two proposed low-power bandgap reference circuits of the present invention both have the advantages of each having the relatively less components than the existing low-power bandgap reference circuits of the prior arts and keeping the same level of the efficiency at the same time through uniquely constituted configurations of circuits each employing two different sets of current mirror circuits with one in the current source of IPTAT and the other in the current source of IPTVBE respectively.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims, which are to be accorded with the broadest interpretation so as to encompass all such modifications and similar structures. Therefore, the above description and illustration should not be taken as limiting the scope of the present invention which is defined by the appended claims.

What is claimed is:

1. A low-power bandgap reference circuit, comprising:

a voltage supply;

a first current source for providing a proportional to absolute temperature (PTAT) current, comprising: a first transistor having a first terminal coupled to said voltage supply, a second terminal providing said PTAT current and coupled to an output terminal of said circuit for providing a bandgap reference voltage, and a control terminal;

a second current source for providing a proportional to base-emitter voltage (PTVBE) current, comprising:

a first resistor having a first terminal coupled to said voltage supply; and a second transistor having a first terminal coupled to a second terminal of said first resistor, a second terminal providing said PTVBE current and coupled to said output terminal, and a control terminal; and a second resistor having a first terminal coupled to said output terminal, and a second terminal coupled to a common ground, wherein said first current source further comprises:

third to sixth transistors each having a first terminal, a second terminal and a control terminal, and having said first terminals of said third and said fourth transistors coupled to said voltage supply, said control and said second terminals of said fourth transistor coupled to said control terminals of said first and said third transistors, said second terminal of said fifth transistor coupled to said control terminal of said second transistor and said second terminal of said third transistor, said second terminal of said sixth transistor coupled to said second terminal of said fourth transistor, said control terminal of said sixth transistor coupled to said control terminal of said fifth transistor, and said first terminal of said sixth transistor coupled to said common ground, respectively;

a third resistor having first and second terminals coupled to said first terminal of said fifth transistor and said common ground, respectively; and a fourth resistor having first and second terminals coupled to said control terminal of said sixth transistor, and said common ground, respectively.

2. The circuit according to claim 1, wherein said second current source further comprises:

a fifth resistor having a first terminal coupled to said voltage supply;

a seventh transistor having a first terminal coupled to a second terminal of said fifth resistor, a second terminal coupled to said first terminal of said fourth resistor, and a control terminal coupled to said control terminal of said second transistor; and a compensating circuit for compensating said PTVBE current, comprising:

a capacitor having a first terminal coupled to said control terminal of said seventh transistor; and a sixth resistor having a first terminal coupled to a second terminal of said capacitor and a second terminal coupled to said control terminal of said sixth transistor.

3. The circuit according to claim 2, wherein said first, said third and said fourth transistors are p-type MOSFETs, said first, said second, and said control terminals of said first, said third, and said fourth transistors are sources, drains, and gates of said MOSFETs, said second and said fifth to said seventh transistors are Bipolar-Junction Transistors (BJTs), said first, said second, and said control terminals of said second and said fifth to said seventh transistors are emitters, collectors, and bases of said BJTs, said second and said seventh transistors are PNP transistors, and said fifth and said sixth transistors are NPN transistors respectively.

4. The circuit according to claim 3, wherein a square measure of p-n junction of said fifth transistor equals to an integer factor multiplied by a square measure of p-n junction of said sixth transistor, and said integer factor is at least 2.

5. A low-power bandgap reference circuit, comprising:

a voltage supply;

a first current source for providing a proportional to absolute temperature (PTAT) current, comprising: a first transistor having a first terminal coupled to said voltage supply, a second terminal providing said PTAT current and coupled to an output terminal of said circuit for providing a bandgap reference voltage, and a control terminal;

a second current source for providing a proportional to base-emitter voltage (PTVBE) current, comprising:

a second transistor having a first terminal coupled to said voltage supply, a second terminal providing said PTVBE current and coupled to said output terminal, and a control terminal;

a first resistor having a first terminal coupled to said output terminal, and a second terminal coupled to a common ground, wherein said first current source further comprises:

third to sixth transistors each having a first terminal, a second terminal and a control terminal, and having said first terminals of said third and said fourth transistors coupled to said voltage supply, said control terminal of said fourth transistor coupled to said control terminal of said first transistor, said second and said control terminals of said third transistor, and said second terminal of said fifth transistor, said second terminal of said sixth transistor coupled to said second terminal of said fourth transistor, said control terminal of said sixth transistor coupled to said control terminal of said fifth transistor, and said first terminal of said sixth transistor coupled to said common ground, respectively;

a second resistor having first and second terminals coupled to said first terminal of said fifth transistor and said common ground, respectively; and a third resistor having first and second terminals coupled to said control terminal of said sixth transistor and said common ground, respectively.

6. The circuit according to claim 5, wherein said second current source further comprises:

a seventh transistor having a first terminal coupled to said voltage supply, a second terminal coupled to said control terminal of said second transistor, and a control terminal coupled to said second terminal; and an eighth transistor having a first terminal coupled to said first terminal of said third resistor, a second terminal coupled to said second terminal of said seventh transistor, and a control terminal coupled to said second terminal of said sixth transistor.

7. The circuit according to claim 6, wherein said first to said fourth and said seventh transistors are p-type MOSFETs, said eighth transistor is an n-type MOSFET, said first, said second, and said control terminals of said first to said fourth and said seventh to said eighth transistors are sources, drains, and gates of said MOSFETs, said fifth and said sixth transistors are Bipolar-Junction Transistors (BJTs), said first, said second, and said control terminals of said fifth and said sixth transistors are emitters, collectors, and bases of said BJTs, and said fifth and said sixth transistors are NPN transistors respectively.

8. The circuit according to claim 7, wherein a square measure of p-n junction of said fifth transistor equals to an integer factor multiplied by a square measure of p-n junction of said sixth transistor, and said integer factor is at least 2.

9. A low-power bandgap reference circuit, comprising:

a voltage supply;

a first current source for providing a proportional to absolute temperature (PTAT) current, comprising:

a first transistor having a first terminal coupled to said voltage supply, a second terminal providing said PTAT current and coupled to an output terminal of said circuit for providing a bandgap reference voltage, and a control terminal;

a second to a fifth transistors each having a first, a second and a control terminals, and having said first terminals of said second and said third transistors coupled to said voltage supply, said second and said control terminals of said third transistor coupled to said control terminals of said first and said second transistors, said second terminal of said fourth transistor coupled to said second terminal of said second transistor, said second terminal of said fifth transistor coupled to said second terminal of said third transistor, said control terminal of said fifth transistor coupled to said control terminal of said fourth transistor, and said first terminal of said fifth transistor coupled to a common ground respectively;

a first resistor having a first and a second terminals coupled to said first terminal of said fourth transistor and said common ground respectively; and a second resistor having a first and a second terminals coupled to said control terminal of said fifth transistor and said common ground respectively;

a second current source for providing a proportional to base-emitter voltage (PTVBE) current, comprising:

a third resistor having a first terminal coupled to said voltage supply; and a sixth transistor having a first terminal coupled to a second terminal of said third resistor, a second terminal providing said PTVBE current and coupled to said output terminal, and a control terminal coupled to said second terminal of said fourth transistor;

a fourth resistor having a first terminal coupled to said voltage supply;

a seventh transistor having a first terminal coupled to a second terminal of said fourth resistor, a second terminal coupled to said first terminal of said second resistor, and a control terminal coupled to said control terminal of said sixth transistor; and a compensating circuit for compensating said PTVBE current, comprising:

a capacitor having a first terminal coupled to said control terminal of said seventh transistor; and a fifth resistor having a first terminal coupled to a second terminal of said capacitor and a second terminal coupled to said control terminal of said fifth transistor; and a sixth resistor having a first terminal coupled to said output terminal of said circuit, and a second terminal coupled to said common ground.

10. The circuit according to claim 9, wherein said first to said third transistors are p-type MOSFETs, said first, said second, and said control terminals of said first to said third transistors are sources, drains, and gates of said MOSFETs, said fourth to said seventh transistors are Bipolar-Junction Transistors (BJTs), said first, said second, and said control terminals of said fourth to said seventh transistors are emitters, collectors, and bases of said BJTs, said fourth and said fifth transistors are NPN transistors, and said sixth and said seventh transistors are PNP transistors respectively.

11. The circuit according to claim 10, wherein a square measure of p-n junction of said fourth transistor equals to an integer factor multiplied by a square measure of p-n junction of said fifth transistor, and said integer factor is at least 2.

12. A low-power bandgap reference circuit, comprising:

a voltage supply;

a first current source for providing a proportional to absolute temperature (PTAT) current, comprising:

a first transistor having a first terminal coupled to said voltage supply, a second terminal providing said PTAT current and coupled to an output terminal of said circuit for providing a bandgap reference voltage, and a control terminal;

a second to a fifth transistors each having a first, a second and a control terminals, and having said first terminals of said second and said third transistors coupled to said voltage supply, said control terminal of said third transistor coupled to said control terminal of said first transistor, said second and said control terminals of said second transistor, and said second terminal of said fourth transistor, said second terminal of said fifth transistor coupled to said second terminal of said third transistor, said control terminal of said fifth transistor coupled to said control terminal of said fourth transistor, and said first terminal of said fifth transistor coupled to a common ground respectively;

a first resistor having a first and a second terminals coupled to said first terminal of said fourth transistor and said common ground respectively; and a second resistor having a first and a second terminals coupled to said control terminal of said fifth transistor and said common ground respectively;

a second current source for providing a proportional to base-emitter voltage (PTVBE) current, comprising:

a sixth transistor having a first terminal coupled to said voltage supply, a second terminal providing said PTVBE current and coupled to said output terminal, and a control terminal;

a seventh transistor having a first terminal coupled to said voltage supply, a second terminal coupled to said control terminal of said sixth transistor, and a control terminal coupled to said second terminal; and an eighth transistor having a first terminal coupled to said first terminal of said second resistor, a second terminal coupled to said second terminal of said seventh transistor, and a control terminal coupled to said second terminal of said fifth transistor; and a third resistor having a first terminal coupled to said output terminal, and a second terminal coupled to said common ground.

13. The circuit according to claim 12, wherein said first to said third, said sixth and said seventh transistors are p-type MOSFETs, said eighth transistor is an n-type MOSFET, said first, said second, and said control terminals of said first to said third and said sixth to said eighth transistors are sources, drains, and gates of said MOSFETs, said fourth and said fifth transistors are Bipolar-Junction Transistors (BJTs), said first, said second, and said control terminals of said fourth and said fifth transistors are emitters, collectors, and bases of said BJTs, and said fourth and said fifth transistors are NPN transistors respectively.

14. The circuit according to claim 13, wherein a square measure of p-n junction of said fourth transistor equals to an integer factor multiplied by a square measure of p-n junction of said fifth transistor, and said integer factor is at least 2.

* * * * *